US005622121A

United States Patent [19]

Holler

[11] Patent Number: 5,622,121

[45] Date of Patent: Apr. 22, 1997

[54] SECURITY COVER FOR JEWELRY CASE

[76] Inventor: John L. Holler, 30237 Sherri Lee Dr., Bulverde, Tex. 78163

[21] Appl. No.: 401,275

[22] Filed: Mar. 9, 1995

[51] Int. Cl.[6] ..... E06B 9/00

[52] U.S. Cl. ..... 109/49.5; 312/114; 312/137; 312/210; 312/262

[58] Field of Search ..... 109/49.5, 78; 206/44 R, 206/45.31; 312/114, 137, 210, 258, 262, 297

[56] References Cited

U.S. PATENT DOCUMENTS

| | | | |
|---|---|---|---|
| 120,874 | 11/1871 | Holmes et al. . | |
| 917,705 | 4/1909 | Benjamin . | |
| 1,095,484 | 5/1914 | Wright . | |
| 1,255,407 | 2/1918 | Goetz . | |
| 1,572,429 | 2/1926 | Grither, Jr. . | |
| 1,920,882 | 8/1933 | Pellow | 312/114 |
| 2,326,713 | 8/1943 | Wesseler | 89/36 |
| 2,515,466 | 7/1950 | Nahmens | 45/68.3 |
| 2,589,699 | 3/1952 | Johnson | 312/204 |
| 2,605,617 | 8/1952 | Replogle | 62/89 |
| 2,677,588 | 5/1954 | Couse | 312/258 |
| 2,717,018 | 9/1955 | Wagner | 150/52 |
| 2,865,569 | 12/1958 | Levenberg | 237/79 |
| 2,943,901 | 7/1960 | Eaton et al. | 312/229 |
| 3,116,097 | 12/1963 | Novales | 312/297 |
| 3,120,076 | 2/1964 | Zuch | 45/68 |
| 3,241,899 | 3/1966 | Donker | 312/116 |
| 3,434,769 | 3/1969 | Salet | 312/258 |
| 3,805,816 | 4/1974 | Nolte | 160/327 X |
| 3,855,898 | 12/1974 | McDonald | 109/49.5 X |
| 4,011,943 | 3/1977 | Galli et al. | 206/44 R |
| 4,128,285 | 12/1978 | Lore et al. | 312/196 |
| 4,280,414 | 7/1981 | Allshouse et al. | 109/49.5 |
| 4,285,558 | 8/1981 | Medford | 312/278 |
| 4,345,635 | 8/1982 | Solomon | 160/133 |
| 4,560,214 | 12/1985 | Otema | 312/114 |
| 4,605,267 | 8/1986 | Rinkewich | 312/297 |
| 4,804,877 | 2/1989 | Harwood | 312/114 |
| 5,125,726 | 6/1992 | Hahn et al. | 312/114 |
| 5,249,534 | 10/1993 | Sacks | 109/49.5 X |
| 5,392,686 | 2/1995 | Sankar | 109/49.5 X |
| 5,483,905 | 1/1996 | Johansson | 109/49.5 X |

FOREIGN PATENT DOCUMENTS

| | | |
|---|---|---|
| 2516281 | 5/1983 | France . |

*Primary Examiner*—Suzanne L. Dino
*Attorney, Agent, or Firm*—Thorpe, North & Western

[57] ABSTRACT

A protective cover for finery cases containing jewelry, precious metals and the like. The cover is made of nontransparent plastic sheets which are hinged together. A J-shaped channel is disposed on the free edge of one of the sheets for interlocking around a lower lip of a jewelry case. The plastic sheets correspond in size to the walls of the jewelry case to permit the sheets to hingedly extend around the edge corners of the case so that each plastic sheet is coextensive with and covers an outer glass-paneled wall of the case. The free edge of the cover opposite the J-shaped channel is locked to the case to prevent removal of the cover, which renders the case nontransparent.

14 Claims, 1 Drawing Sheet

SECURITY COVER FOR JEWELRY CASE

BACKGROUND OF THE INVENTION

1. The Field of the Invention

The present invention relates generally to jewelry case covers. More particularly, it concerns a nontransparent jewelry case cover comprised of bullet-proof plastic.

2. The Background Art

Jewelers and other merchants of finery are faced with the challenge of displaying their wares without incurring substantial risk of theft. Jewelry is usually displayed in plate-glass jewelry cases designed to maximize visual access to the jewelry by customers. Of course, the more accessible the jewelry, the greater the risk that the jewelry will be stolen. The conventional wisdom in the field of jewelry case security is to fortify the jewelry case against smash and grab type theft without compromising visual access to the jewelry. To this end, armor plated transparent film has been developed which is wrapped around jewelry cases. The armor plated film inhibits the ability of a thief to break through the jewelry case.

Such protective film, while perhaps effective during business hours, has a number of disadvantages when relied upon for nighttime protection. Although the film is armor plated, it can be penetrated and compromised. The transparent nature of the film preserves visual access for customers, but it also provides an incentive to thieves who have broken into the store after hours to break through the film. Jewelers must often undertake the tedious task of removing the jewelry from the display case every evening and replacing it every morning of the business week. Further, although the film is transparent, it is not removable and usually darkens the case to some degree, which is distracting to sales presentations because it alters the true luster of the jewelry displayed.

OBJECTS AND SUMMARY OF THE INVENTION

It is therefore an object of the present invention to provide a removable jewelry case cover which inhibits unauthorized entry to a jewelry case.

It is another object of the invention to provide such a jewelry case cover which is simple in design and manufacture.

It is a further object of the invention to provide such a jewelry case cover which precludes visual access to the contents of the underlying jewelry case and is therefore more conducive to nighttime protection.

The above objects and others not specifically recited are realized in a specific illustrative embodiment of a protective cover for finery cases containing jewelry, precious metals and the like. The cover is made of nontransparent plastic sheets which are hinged together. A J-shaped channel is disposed on the free edge of one of the sheets for interlocking around a lower lip of the jewelry case. The plastic sheets correspond in size to the walls of the jewelry case to permit the sheets to hingedly extend around the edge corners of the case so that each plastic sheet is coextensive with and covers an outer glass-paneled wall of the case. The free edge of the cover opposite the J-shaped channel is locked to the case to prevent removal of the cover, which renders the case nontransparent.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
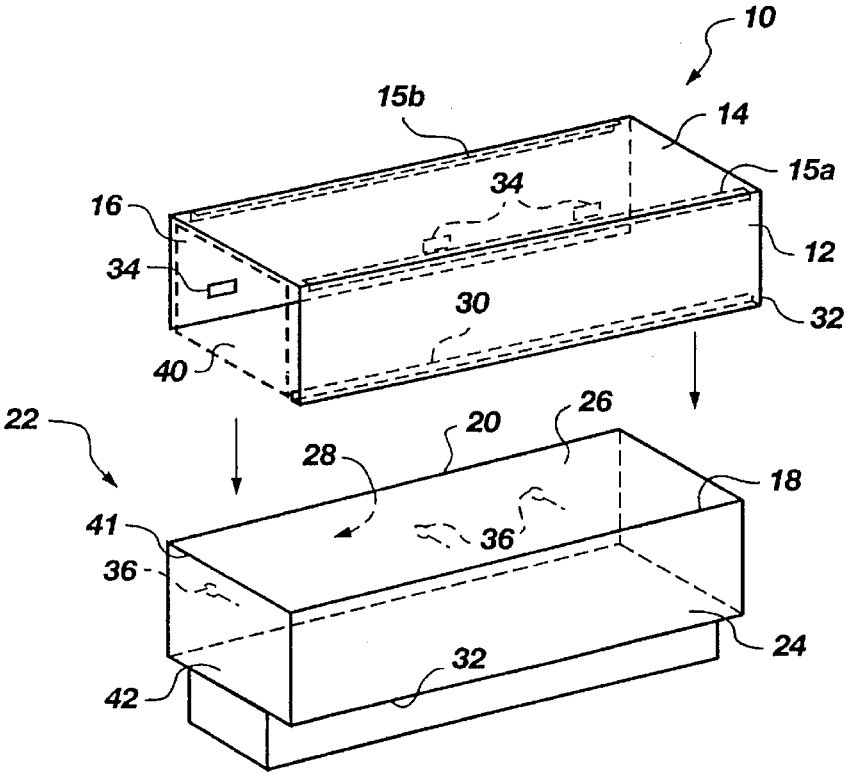
FIG. 1 is a perspective view of a protective cover for finery cases, made in accordance with the principles of the present invention.
Figure 2:
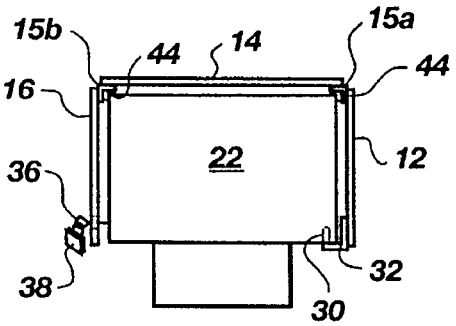
FIG. 2 is a side view of the cover of FIG. 1 in an installed position.

Referring now to FIGS. 1–2, there is shown a protective jewelry case cover, generally designated at 10, made in accordance with the present invention. The cover 10 includes first, second and third hingedly connected sidewalls 12, 14 and 16, respectively, such that the first and third sidewalls 12 and 16 are hingedly attached along two opposing edges of the second sidewall 14 with hinge members 15*a–b* to form a three-sided cover member. The cover 10 is configured and dimensioned to hingedly extend around first and second edge corners 18 and 20 of a finery case designated generally at 22 to thereby cover first, second and third walls 24, 26 and 28 of the case 22. The phrase "to hingedly extend" around something such as an edge corner, as used herein, shall refer to a hinged member which folds around an edge corner with a hinge, as illustrated most clearly in FIG. 2.

The sidewalls 12, 14 and 16 are made from nontransparent plastic sheets, preferably from bullet-proof black Lexan™ or equivalent ABS plastic. The word "nontransparent" as used herein shall refer broadly to an object which the unaided human eye cannot see through, and includes the qualities of translucency and opaqueness. In accordance with the invention, therefore, onlookers cannot tell by looking at the jewelry case 22 whether it contains any finery, since its glass walls 24, 26 and 28 are covered by the nontransparent plastic sheets 12, 14 and 16, respectively. The sidewalls 12, 14 and 16 may thus be made from any color of plastic which is sufficiently dark as to be nontransparent. The sidewalls may also be made of clear plastic sheets having an etched finish, wherein the etched finish operates to refract light passing therethrough so as to render said sidewalls nontransparent. The most preferred embodiment includes black plastic sidewalls having an etched finish which is scratch resistent so as to avoid the appearance of wearing over time.

Figure 3:
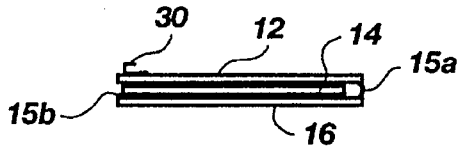
FIG. 3 is a side view of the cover of FIGS. 1–2 in a folded configuration.

A J-shaped channel 30 is disposed along a free edge section 32 of the first sidewall 12 opposite the hinge 15*a*. The J-shaped channel 30, in totality, constitutes a three-sided one-piece unitary U-shaped channel which extends along a majority length of the free edge section 32 of the first sidewall 12, as shown in FIGS. 1–3. The term "free edge section" as used herein shall refer broadly to some surface portion which includes a free edge, such as anywhere along the half of the sidewall 12 opposite the hinge 15*a*. The J-shaped channel 30 thus does not need to be secured exactly to the free edge itself but may be attached to any suitable part of the sidewall 12. The J-shaped channel 30 is configured and dimensioned to interlock around a free edge 32 of the case 22 when the first, second and third sidewalls 12, 14 and 16 are covering the first, second and third walls 24, 26 and 28 of the case 22, as shown in FIG. 2.

A free edge section of the third sidewall 16 includes slots 34 formed therein which correspond to eyelets 36 secured to the case 22. The slots 34 permit passage of the eyelets 36 through the third sidewall 16 when the first, second and third sidewalls 12, 14 and 16 are covering the first, second and third walls 24, 26 and 28 of the case 22, as shown in FIG. 2. Locking devices such as padlocks 38 attach to the eyelets 36 to lock the cover 10 to the case 22. The combination of the padlocks 38 and the J-shaped channel 30 being interlocked around the free edge 32 of the case 22 co-act to prevent removal of the cover 10 from the case 22.

Referring now to FIG. 3, the cover 10 is foldable onto itself such that the second sidewall 14 is sandwiched between the remaining sidewalls. The sidewalls are preferably about 0.25 inches thick, or otherwise of a thickness such that the first, second and third sidewalls 12, 14 and 16 are collectively less than one inch thick when fold as in FIG. 3.

Padding members 44 are disposed on the hinged portions 15*a–b* (hinges) so as to reside sandwiched between the hinges 15*a–b* and the jewelry case 22 when the sidewalls 12, 14 and 16 are covering the walls 24, 26 and 28 of the case. The padding members 44 preferably comprise VELCRO™ material, or some other suitably durable cloth to prevent the hinges 15 from wearing through the cloth and scratching the jewelry case 22.

The present invention may include any number of hinged sidewalls. For example, only two hinged sidewalls may be suitable to cover a jewelry case having only two adjacent glass panels. Or, a fourth sidewall 40 (shown in phantom line in FIG. 1) may be included to hingedly extend around a third edge corner 41 in order to cover a side panel 42 of the case 22. The sidewalls of the cover 10 may embody any suitable shape or number, as shown for example by the polygonal-sided cover member 60 in FIG. 4.

Figure 4:
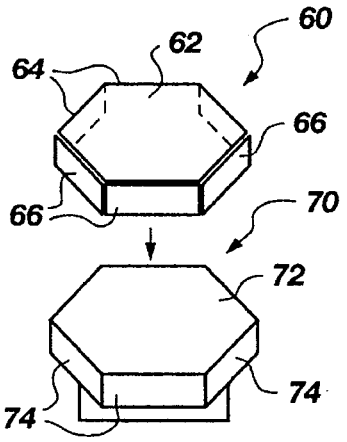
FIG. 4 is a perspective view of an alternative embodiment of the cover of FIGS. 1–3.

Referring now to FIG. 4, the polygonal cover 60 includes a central polygonal sidewall 62 having a plurality of polygonal edges 64. A plurality of outer sidewalls 66 are hingedly attached along at least some of the plurality of polygonal edges 64, respectively, to form an at least partially polygonal-sided cover member configured and dimensioned to hingedly extend around polygonal edge corners 66 of a finery case 70 having a polygonal wall 72 and connecting outer walls 74 to thereby cover said walls 72 and 74. In this embodiment, any suitable locking means for locking a free edge section of each outer sidewall 66 of the cover 60 to the polygonal finery case 70 is sufficient to secure the cover 60 to the case 70.

A preferred method for covering transparent walls of a finery case so as to prevent onlookers from witnessing any contents of the case comprises the steps of:

(a) placing a nontransparent cover member having a first sidewall hingedly attached to a second sidewall onto the finery case in a seated position such that said cover member hingedly extends around an edge corner of the finery case to thereby cover with said first and second sidewalls at least two adjacent walls of said finery case forming said edge corner, respectively; and (b) releasably securing the nontransparent cover member to the finery case in said seated position.

Applicant notes that the prior art armor plated film covers fail to solve adequately the problem of displaying jewelry without incurring substantial risk of theft. One of the key features of the present invention is to render the glass panel of a jewelry display case nontransparent. The cover 10 is installed over the case 22 after business hours and removed the next morning. If an unauthorized individual gains access to the jewelry store after business hours, the nontransparent cover 10 introduces doubt into his or her mind as to whether the jewelry cases contain anything at all, and as to which case contains the most valuable finery. By preventing a thief from seeing the contents of a jewelry case, the cover 10 introduces an element of doubt which slows the thief down and buys more time for the authorities to detect the unlawful presence of the thief. The cover 10 snaps on to the case 22 easily and obviates the need for a clerk to handle and unload the jewelry case at night, only to reload the case again the next morning.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A protective cover for a finery case containing jewelry, precious metals or other finery, said finery case having a free edge and at least first, second and third walls forming first and second edge corners, said protective cover comprising:

a nontransparent cover means including a first sidewall hingedly attached to a second sidewall and a third sidewall hingedly attached to said second sidewall such that said first and third sidewalls are hingedly attached along two opposing edges of the second sidewall to form an at least three-sided nontransparent cover means for (i) placing onto the finery case in a seated position and for (ii) hingedly extending around the first and second edge corners of the finery case to thereby cover with said first, second and third sidewalls the first, second and third walls of said finery case forming said edge corners, respectively, so as to render said walls nontransparent, wherein the first and third sidewalls each have a free edge section; and securing means for releasably securing the nontransparent cover means to the finery case in said seated position, said securing means comprising:

a three-sided, one-piece unitary U-shaped channel disposed along a free edge section of the first sidewall opposite the hinged portion of said first sidewall, said U-shaped channel being configured and dimensioned to interlock around the free edge of the finery case when the first, second and third sidewalls of the nontransparent cover member are covering the first, second and third walls of the finery case; and locking means for locking a free edge section of the third sidewall of the nontransparent cover member to the finery case when the U-shaped channel is interlocked around the free edge of the finery case to thereby secure the nontransparent cover member over the first, second and third walls of said finery case.

2. A protective cover as defined in claim 1, wherein the locking means comprises eyelet members secured to the finery case and slots formed in the free edge section of the third sidewall, said slots being configured and positioned to enable passage therethrough of the eyelet members when the first, second and third sidewalls of the nontransparent cover member are covering the first, second and third walls of the finery case, said locking means further comprising padlock means being affixable to the eyelet members to thereby inhibit removal of the third sidewall away from the third wall of the finery case.

3. A protective cover as defined in claim 1, wherein the second sidewall of the transparent cover member includes first and second opposing edges and third and fourth opposing edges, the first and third sidewalls being hingedly attached along said first and second opposing edges, wherein the nontransparent cover member further comprises a fourth sidewall hingedly attached along the third edge of the second sidewall to form an at least four-sided nontransparent cover member configured and dimensioned to hingedly extend around first, second and third edge corners of the finery case to thereby cover with said first, second, third and fourth sidewalls first, second, third and fourth walls of said finery case forming said edge corners, respectively, so as to render nontransparent said first, second, third and fourth walls with the first, second, third and fourth sidewalls, respectively.

4. A protective cover as defined in claim 1, wherein the nontransparent cover member comprises:

a central polygonal sidewall having a plurality of polygonal edges, and a plurality of outer sidewalls hingedly attached along at least some of the plurality of polygonal edges, respectively, to thereby form an at least partially polygonal-sided nontransparent cover member configured and dimensioned to hingedly extend around polygonal edge corners of a finery case having a polygonal wall and connecting outer walls so as to cover and render nontransparent said polygonal wall and at least some of said connecting outer walls of said finery case, wherein the securing means further comprises:

locking means for locking a free edge section of each outer sidewall opposite the hinged portion thereof to the finery case.

5. A protective cover as defined in claim 1, wherein the sidewalls of the nontransparent cover member comprise clear plastic sheets having an etched finish, wherein said etched finish operates to refract light passing therethrough so as to render said sidewalls nontransparent.

6. A protective cover as defined in claim 5, wherein the plastic sheets comprise bulletproof ABS plastic.

7. A protective cover as defined in claim 1, wherein the sidewalls of the nontransparent cover member comprise darkened ABS bulletproof plastic which are sufficiently dark to be nontransparent.

8. A protective cover as defined in claim 1, wherein the sidewalls of the nontransparent cover member comprise translucent bulletproof plastic sheets.

9. A protective cover as defined in claim 1, wherein the nontransparent cover member is foldable onto itself such that one of its sidewalls is sandwiched between the remaining sidewalls and wherein the sidewalls are of a thickness such that the nontransparent cover is less than one inch thick when so folded.

10. A protective cover as defined in claim 1, further comprising:

padding means disposed upon the hinged portions so as to be sandwiched between said hinged portions and the finery case when the first, second and third sidewalls of the nontransparent cover member are covering the first, second and third walls of the finery case to thereby substantially prevent said hinged portions from scratching said finery case.

11. A protective cover as defined in claim 1, wherein the three-sided, one-piece unitary U-shaped channel is elongate and extends along a majority length of the free edge section of the first sidewall.

12. A protective cover as defined in claim 10, wherein the three-sided, one-piece unitary U-shaped channel is elongate and extends along a majority length of the free edge section of the first sidewall.

13. A method for covering transparent walls of a finery case containing jewelry, precious metals or other finery so as to prevent onlookers from witnessing any contents of the finery case, said finery case having a free edge and at least first, second and third walls forming first and second edge corners, said method comprising the steps of:

(a) placing a nontransparent cover member having first and third sidewalls hingedly attached to a second sidewall onto the finery case in a seated position such that said cover member hingedly extends around the first and second edge corners of the finery case to thereby cover with said first, second and third sidewalls the first, second and third walls of said finery case forming said edge corners, respectively; and (b) releasably securing the nontransparent cover member to the finery case in said seated position by (1) attaching a three-sided, one-piece unitary U-shaped channel along a free edge section of the first sidewall opposite the hinged portion of said first sidewall, and interlocking U-shaped channel around the free edge of the finery case when the first, second and third sidewalls of the nontransparent cover member are covering the first, second and third walls of the finery case; and (2) locking a free edge section of the third sidewall of the nontransparent cover member to the finery case when the U-shaped channel is interlocked around the free edge of the finery case to thereby secure the nontransparent cover member over the first, second and third walls of said finery case.

14. A method as defined in claim 13:

wherein step (a) further comprises placing a three-sided nontransparent cover member having first and third sidewalls hingedly attached along two opposing edges of the second sidewall onto the finery case in a seated position such that said cover hingedly extends around first and second edge corners of the finery case formed by first, second and third walls of the finery case to thereby cover said walls with the first, second and third sidewalls of the cover, respectively;

wherein step (b) further comprises interlocking a J-shaped channel disposed along a free edge section of the first sidewall around a free edge of the finery case with the nontransparent cover member in the seated position, and locking a free edge section of the third sidewall of the nontransparent cover member to the finery case when the J-shaped channel is interlocked around the free edge of the finery case to thereby secure the nontransparent cover member in the seated position.

* * * * *